US009567198B2

(12) United States Patent
Fahldieck et al.

(10) Patent No.: US 9,567,198 B2
(45) Date of Patent: Feb. 14, 2017

(54) DEVICE FOR CLOSING CONTAINERS

(75) Inventors: Andreas Fahldieck, Idar-Oberstein (DE); Manfred Hartel, Bretzenheim (DE); Heinz Hillmann, Obrigheim (DE); Thomas Schneider, Kirn (DE)

(73) Assignee: KHS GmbH, Dortmund (DE)

( * ) Notice: Subject to any disclaimer, the term of this patent is extended or adjusted under 35 U.S.C. 154(b) by 436 days.

(21) Appl. No.: 14/234,689

(22) PCT Filed: Jun. 2, 2012

(86) PCT No.: PCT/EP2012/002350

§ 371 (c)(1),
(2), (4) Date: Jan. 24, 2014

(87) PCT Pub. No.: WO2013/013735

PCT Pub. Date: Jan. 31, 2013

(65) Prior Publication Data

US 2014/0174029 A1 Jun. 26, 2014

(30) Foreign Application Priority Data

Jul. 26, 2011 (DE) ..... 10 2011 108 428

(51) Int. Cl.
*B67B 3/20* (2006.01)

(52) U.S. Cl.
CPC ..... *B67B 3/2066* (2013.01); *B67B 3/2033* (2013.01); *B67B 3/2053* (2013.01); *B67B 2201/08* (2013.01)

(58) Field of Classification Search
CPC ..... B67B 3/20; B67B 3/2013; B67B 3/2033; B67B 3/204; B67B 3/2053; B67B 3/2066; B67B 2201/08; B67B 3/28; B65B 3/28; B65B 7/2835; B67C 7/0073; B67C 2007/0066
USPC ..... 53/281, 282, 300, 317, 331.5, 368
See application file for complete search history.

(56) References Cited

U.S. PATENT DOCUMENTS

| | | | | |
|---|---|---|---|---|
| 5,809,742 | A * | 9/1998 | Takakusaki et al. | B67B 3/2033 53/317 |
| 7,536,839 | B2 * | 5/2009 | Kemper et al. | A61L 2/22 53/309 |
| 7,882,681 | B2 * | 2/2011 | Bernhard | B67B 3/28 53/300 |
| 2010/0126116 | A1 * | 5/2010 | Buchhauser et al. | B67B 3/2033 53/287 |
| 2010/0212259 | A1 * | 8/2010 | Knieling et al. | B67B 3/2033 53/285 |

(Continued)

FOREIGN PATENT DOCUMENTS

| | | | | |
|---|---|---|---|---|
| DE | 198 55 975 | | 3/2000 | |
| DE | 19855975 | C1 * | 3/2000 | B67C 3/2614 |

(Continued)

*Primary Examiner* — Stephen F Gerrity
(74) *Attorney, Agent, or Firm* — Occhiuti & Rohlicek LLP

(57) ABSTRACT

A closing machine for closing containers has closing stations. Each station has a closer tool, a magnetically acting coupling element, a drive space, a product space, a linear drive, and a driver. The magnetically acting coupling element has inner and outer magnet elements. The drive space is formed separately from the product space. The linear guide positively drives the outer magnet element. The driver positively carries along said closer tool in a required height movement.

20 Claims, 4 Drawing Sheets

(56) References Cited

U.S. PATENT DOCUMENTS

2010/0307110 A1* 12/2010 Wilhelm et al. ..... B67B 3/28
53/329.2

FOREIGN PATENT DOCUMENTS

| | | | | |
|---|---|---|---|---|
| DE | 10 2007 057857 | | 6/2009 | |
| DE | 102007057857 | A1 * | 6/2009 | ..... B67B 3/2033 |
| DE | 10 2008 056242 | | 5/2010 | |
| DE | 102008056242 | A1 * | 5/2010 | ..... B67B 3/2033 |
| DE | 10 2009 009 822 | | 8/2010 | |
| DE | 102009009822 | A1 * | 8/2010 | ..... B67B 3/2033 |
| DE | 10 2009 017109 | | 10/2010 | |
| DE | 102009017109 | A1 * | 10/2010 | ..... B67B 3/2033 |
| EP | 2187505 | A2 * | 5/2010 | ..... B67B 3/20 |
| EP | 2 221 272 | | 8/2010 | |
| EP | 2221272 | A2 * | 8/2010 | ..... B67B 3/2033 |

* cited by examiner

DEVICE FOR CLOSING CONTAINERS

RELATED APPLICATIONS

Under 35 USC 371, this application is the national stage entry of PCT/EP2012/002350, filed on Jun. 2, 2012, which claims the benefit of the Jul. 26, 2011 priority date of German application DE 10 2011 108 428.6, the content of which is herein incorporated by reference.

FIELD OF INVENTION

The invention relates to a device or installation for closing containers comprising a plurality of closer stations at the periphery of a rotor that can be driven to circulate around the vertical machine axis; the closer stations each having a closer tool.

BACKGROUND

Devices for closing containers are known in various embodiments according to DE102007057857 as closing machines for closing bottles with screw closures that are fixed by screwing on or screwing to a thread on the exterior of the bottle in the area of the bottle's mouth.

In principle, the placement of a particular closure is carried out with a closer tool or closing cone in which the bottle closure is held until placed on a bottle, and that can be driven in a rotating manner by a drive to place the closure on the bottle or to screw the closure onto the bottle.

During the entire closing process, due to the geometric circumstances on a closing machine, it is regularly required to change the distance between the lower edge of the closing cone and the upper edge of the bottle mouth, e.g. to compensate for the change in distance resulting from the screwing-on operation. In certain embodiments of known closers, this occurs by the lower edge of the closing cone remaining at one height level while the container to be closed carries out all the necessary vertical movements.

As DE102007057857 A1 further discloses, known closing machines, i.e. screw cappers and also (crown) corking machines, have a plurality of closer stations at the periphery of a rotor which can be driven to circulate around the vertical machine axis, said closer stations each having a closer tool and a bottle or container holder, which can be controlled to move upwards and downwards through a lifting curve while the rotor rotates to feed the particular bottle to the closer tool before the closing and to detach the closed bottle from the closer tool. However, embodiments are known in which both the container and also the closer tool each carry out part of the necessary movement to achieve closure of a container.

Also known are closing machines in which containers are closed with crown corks. With these closing machines too, there are also changes in the distance that likewise require compensation. This can take place as described previously. Naturally in this case, a screw movement of the closing stamp is not needed.

Also known are closing machines controlled by mechanical lifting cams. Among their drawbacks is their susceptibility to wear. To address this, DE102007057857 makes the practical suggestion of replacing the lifting cam by a controlled and adjusted drive.

This suggestion of DE102007057857 has proven itself in practice as the necessary height movement was designed to be freely programmable. For controlled or adjustable, linear movement, an in-line motor could be used for example. It has furthermore been suggested that the screw spindle of a screw capper or the closing stamp of a (crown) corking machine be made as armatures and hence have magnets.

DE102009017019 concerns a closing machine in which a rotational force is magnetically transferred from the drive shaft to the closer tool. This too has proved itself in practice.

The use of magnetically acting elements to prevent mechanical wear is thus known. However, the particular magnetic coupling elements, for example, the linear motor of DE102007057857, are disposed in the product space itself. This entails considerable cleaning effort if, for example, product filled into the container overflows or otherwise escapes onto the various elements.

SUMMARY

According to the invention, the task is resolved by a device in which a particular closer station has a magnetically acting coupling element that has a first inner magnet element and a second outer magnet element, whereby a drive space is formed separately from a product space, and the second outer magnet element is positively driven on a linear guide, and the closer tool is likewise carried along positively by means of a driver in a necessary height movement.

In a preferred embodiment, a dividing wall can be disposed between the first inner magnet element and the second outer magnet element so that the dividing wall separates the product space from the working space. In particular, the dividing wall can separate a sterile or a sterilizable product space from an unsterile working space.

In relation to the vertical machine axis of a rotary machine, the first inner magnet element seen in a radial direction is disposed closer to the vertical machine axis than the second outer magnet element. In a linear machine, similarly, the drive and motor side is "inside" and the space in which the containers are transported or closed is "outside".

It is expedient in the meaning of the invention if the particular magnet element is made as a magnet driver on which magnets are arranged. The magnets can be permanent magnets or electromagnets. If permanent magnets are provided, they are arranged with alternating polarities.

In a first embodiment, the first inner magnet element itself is arranged on a linear guide, whereby the first inner magnet element can be moved in a vertical direction by motor or by means of a control curve. An advantage of this configuration is that the first inner magnet element can be moved at least along the vertical machine axis. The magnetic forces carry along the second outer magnet element and transfer the height movement via the previously mentioned linear guide onto the closer tool.

Expediently, for the transmission of the height movement from the second outer magnet element onto the closer tool, transmission means are or the driver is provided which has at least one connecting arm, which is arranged on a guide sleeve, wherein the guide sleeve includes a section of the closer tool or a section of its shaft and is fixed to the latter. This guide sleeve can also have a number of two or more guide rods or similar, and serves for the transmission of rotational force onto the closing head while there is a simultaneous relative change of distance between the drive motor and the closure head. If the closure tool is in the form of a screw-on closure tool, it must naturally be possible to rotate it. It is therefore sensible for the guide sleeve to be connected by means of bearings to the corresponding section of the closer tool so that both the necessary height movement and also a necessary rotation of the closer tool is possible.

In the first preferred embodiment, it is provided that the closer tool carries out the necessary height movement, whereby the container is held unchangeably on the container holder seen in a vertical view. It is expedient in the meaning of the invention if the closer tool has a shaft with a fixed shaft part and a moveable shaft part so that a variable-length, for example telescopic, shaft is formed. In this way, the necessary height movement, which is transmitted by means of the second outer magnet element, is carried out by the closing cone or the closing stamp.

It is expedient for the dividing wall to be provided as, preferably, a rigid dividing wall between the two magnet elements, the dividing wall separating the product space from the first inner magnet element on which the drive works to generate the necessary height movement. The dividing wall runs parallel to the vertical machine axis at least in the area of the two magnet elements. Between the dividing wall and the one magnet element, an air gap is preferably provided. In the further extension of the dividing wall, it can be designed freely in its run. An embodiment is feasible in which the dividing wall runs with one section inclined from the vertical machine axis oriented in a path to then transition into a section again running parallel to the vertical machine axis. A run-off area oriented diagonally downwards of the dividing wall is thus effectively formed with the inclined section.

The dividing wall can be made, at least in the area of the magnet elements, or their possible travel path, of a magnetizable material, preferably of a magnetizable stainless steel, e.g. with material number 1.4112. Naturally, the dividing wall can be made completely of a uniform material. A magnetizable material is not absolutely necessary. It is also feasible for the dividing wall to be made of a suitable plastic or a stainless steel.

It is expedient that, with a linear shift of the first inner magnet element along the vertical machine axis, thus both upwards and downwards, i.e. with a shift of the inner magnet element relative to the outer magnet element, from a pure attraction also a repelling effect forms, whereby the friction in the linear guide elements of the magnet elements is reduced, whereby naturally the outer magnet element is accordingly carried along. Advantageously, due to the reduced friction, thus also the simplest slide bearings can be used as linear guide elements, whereby naturally also low-friction ball-bearings are feasible, but however this is advantageously not necessary, thereby reducing costs.

In a first possible embodiment, all the components rotate together with the rotor around the vertical machine axis.

A further possible embodiment provides that the first inner magnet element is made stationary along the vertical machine axis, but also seen in the circumferential direction, i.e. in the direction of rotation of the rotor, and as a lift control cam, whereby the second outer magnet element, when operating as intended, rotates around the vertical machine axis and follows the path of the first inner magnet element in the vertical direction.

The dividing wall is in turn arranged between the two magnet elements, but likewise rotates with the second outer magnet element around the vertical machine axis.

It is expedient for the first inner magnet element to be formed from a stationary driver and magnets arranged on it, so that effectively a continuous column rotating around the vertical machine axis in the direction of rotation is formed. The magnets are arranged on the driver in the vertical direction and circumferential direction so that the second outer magnet element is carried along by the magnetic forces effectively on a lifting curve, whereby this movement is transmitted in the previously described way onto the closer tool. Advantageous here again is that the second outer magnet element is carried along positively in the linear guide, and carries along the closer tool by means of the connecting arm or by means of the connecting arms and the guide sleeve in the necessary height movement.

The container driver can here be arranged on the linear guide of the second outer magnet element, and is thus mounted in a stationary manner with regard to its height position. The container driver can preferably be arranged on a free foot end of the linear guide.

In a further possible embodiment, the magnets can be arranged on an inner periphery of the column or the driver, whereby the column wall could assume the function of the dividing wall.

Instead of permanent magnets, controllable electro-magnets can also preferably be provided on the first inner magnet element, the controllable electro-magnets, appropriately controlled, forming a lifting cam seen in the circumferential and vertical direction, the cam being followed by the second outer magnet element.

With the invention, thus a device is provided that separates the product space, in particular a sterile or sterilizable product space, from the first inner magnet element, for example by means of the dividing wall. Achieved advantageously in this way is that the drive unit for the necessary height movement of the closer tool is separated from the product space, whereby also other components previously arranged in the product space are now separated from it. As the latter are now separated from the product space, the cost of cleaning them is also reduced. Compared with the solution according to the invention, conventional solutions, such as e.g. bellows enveloping them, harbor drawbacks with regard to both the ease with which they can be cleaned and the limited service life of the protective material.

BRIEF DESCRIPTION OF THE DRAWINGS

Further advantageous embodiments of the invention are disclosed in the subsidiary claims and the following description of the figures, in which:

In the various figures, the same parts are always given the same reference symbols, and hence they are generally also only described once and only entered once in the figures.

DETAILED DESCRIPTION

Figure 1:
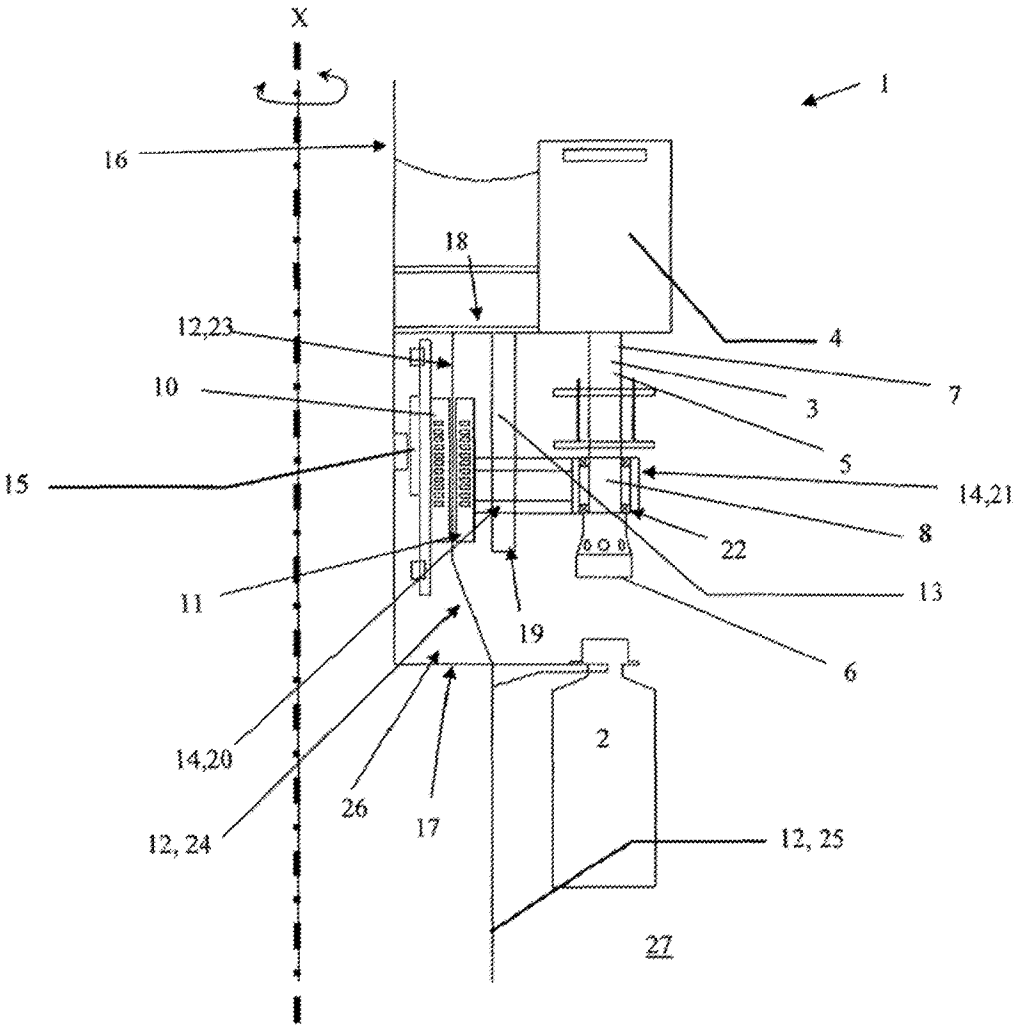
FIG. 1 shows an outline sketch of a side view of a single closer station.

FIG. 1 shows a single closer station 1 of a device or installation for closing containers 2. The device can also be described as a closing machine. The device has a plurality of closer stations 1 on the periphery of a rotor 16 that can be driven to rotate around the vertical machine axis X. The closer stations each have a closer tool 3.

In the illustrated embodiment, the closer tool 3 can be moved in rotational movements by a rotary drive 4. In this regard, FIG. 1 shows, by way of example, a device for closing containers 2 with screw caps.

The closer tool 3 has a shaft 5 to which a working section or cone 6 is connected. The cone 6 can hold the screw cap. The length of the shaft 5 can be variable, for example telescopic, with a stationary shaft part 7 and a shaft part 8 that can be moved relative to it. The stationary shaft part 7 is connected to the rotary drive 4. The movable shaft part 8 is connected to the cone 6.

The particular closer station 1 has a magnetically acting coupling element 9 (FIG. 2) that has a first inner magnet element 10 and a second outer magnet element 11, that are separated as illustrated, and only by way of example, by a dividing wall disposed between them. A driver 14 positively guides the second outer magnet element 11 on an outer linear guide 13 in a necessary height movement. The outer magnet element 11 likewise positively carries the closer tool 3.

The first inner magnet element 10 can be moved on an inner linear guide 15 along the vertical machine axis X or parallel to it, for the purpose of which a drive, not illustrated, can be provided. The drive can be controlled, and moves the first inner magnet element according to the control signals generated, for example, in a control unit. The control signals correspond to the necessary or required height movement, thus effectively a lifting cam. In this regard, the lifting cam is preferably held in the control unit. Also feasible is the generation of a particular lifting curve with corresponding measuring and pick-up elements so that a lifting curve constantly adapted to operational needs can be achieved.

The terms "inner" and "outer" refer in each case to the vertical machine axis X whereby, in the drawing plane, the inner components in each case are arranged closer to the vertical machine axis X than the outer components.

The rotary drive 4 and also a container driver 17 are connected to the rotor 16. The outer linear guide 13 is arranged on a connecting device 18 of the rotary drive 4 of the rotor 16. The outer linear guide 13 extends from the connecting device 18 and is oriented in a path parallel to the vertical machine axis X running with its free end 19 oriented downwards.

The driver 14 is provided on the moveable shaft part 8 of the shaft 5. The driver 14 has connecting arms 20 and a guide sleeve 21. By way of example, two connecting arms 20 are shown, but this is not intended to be restrictive. Also feasible is a single connecting arm 20 or more than two such arms. The connecting arms 20 are fixed, on the one hand, to the second outer magnet element 11, and on the other, to the guide sleeve 21. The guide sleeve 21 covers the moveable shaft part 8 of the shaft 5 completely. The guide sleeve 21 can be completely closed or partially open. Furthermore, the guide sleeve 21 has a bearing device 22 that simultaneously allows a rotary and also a translational movement. In this way, the moveable shaft part 8 of the shaft 5 can be moved along or parallel to the vertical machine axis X. The moveable shaft part 8 of the shaft 5 can however also rotate, this being according to the direction of rotation defined by the rotary drive 4.

The dividing wall 12, which is solely an example, is connected by its head to the connecting device 18, and extends over the free end 19 of the outer linear guide 13 in a downward direction.

As shown in the embodiment of FIG. 1, the optional dividing wall 12 has three sections, a first section 23 of which runs in a straight line parallel to the vertical machine axis X. The first section 23 can also be regarded as a guide section 23 as it separates the two magnet elements 10 and 11 from each other. The first section 23 transitions into a second section 24 that is oriented diagonally outwards and downwards. The second section can also be described as a run-out section 24 due to its incline being oriented diagonally outwards and downwards. To the second section 24 there is connected a third section 25 that extends parallel to the vertical machine axis X.

The longitudinal extension of the first section 23 or of the guide section 23 is favorably adapted to a maximum movement amplitude to be expected of the first inner magnetic element 10 or the second outer magnet element 11. Expedient here is to make the guide section 23 oversized in its longitudinal extension so that a largely free adjustability or every possibly necessary height movement can be achieved.

In FIG. 1, the benefit of the dividing wall 12, which effectively separates a drive space 26 from a product space 27, can be seen. In this way, for example, a simplified cleaning can be achieved of not only the components oriented from the product space 27 but also of the components arranged in the product space 27. In particular, a sterile or sterilizable product space 27 can be separated from an unsterile working space 26.

Figure 2:
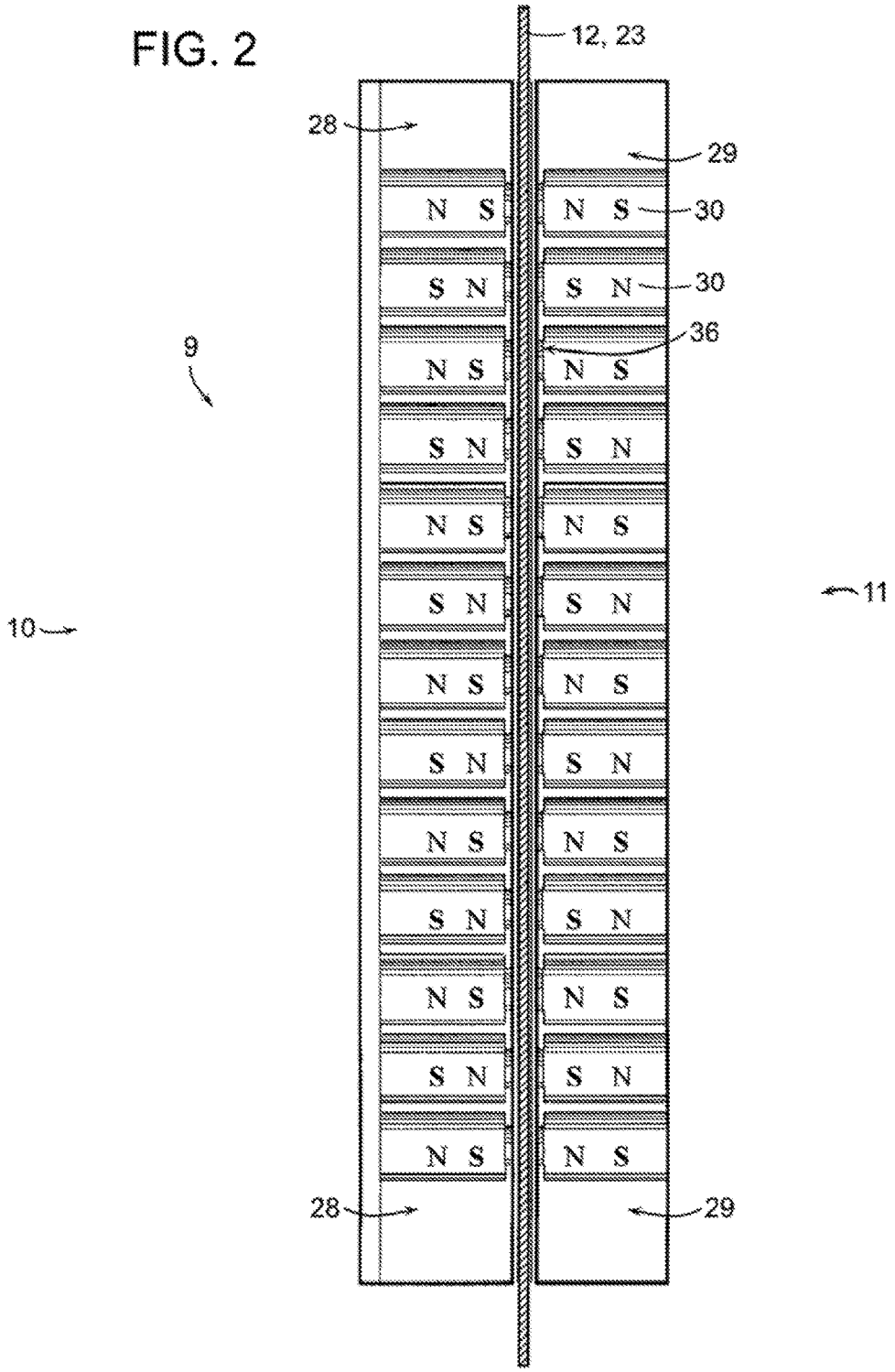
FIG. 2 shows a section of a first and second magnet element as a magnification from FIG. 1.

The magnet elements 10 and 11 are shown magnified in FIG. 2. Between the two magnet elements 10 and 11, there is arranged the dividing wall 12 with its guide section 23. At the top and bottom, in each case magnetic drivers 28 and 29 are provided. Permanent magnets 30 are arranged between the particular drivers 28 and 29. These magnets each alternate in their polarity both in the vertical direction and also from inside to out, as can be seen from the polarity labeling shown in each permanent magnet 30.

As can also be seen in FIG. 2, an air gap 36 is arranged between the outer magnet 11 and the dividing wall 12.

If the first inner magnet element 10 is now moved relative to the second outer magnet element 11, the second magnet element 11 is carried along, whereby the cone 6 is also carried along positively by positive entrainment.

Figure 3:
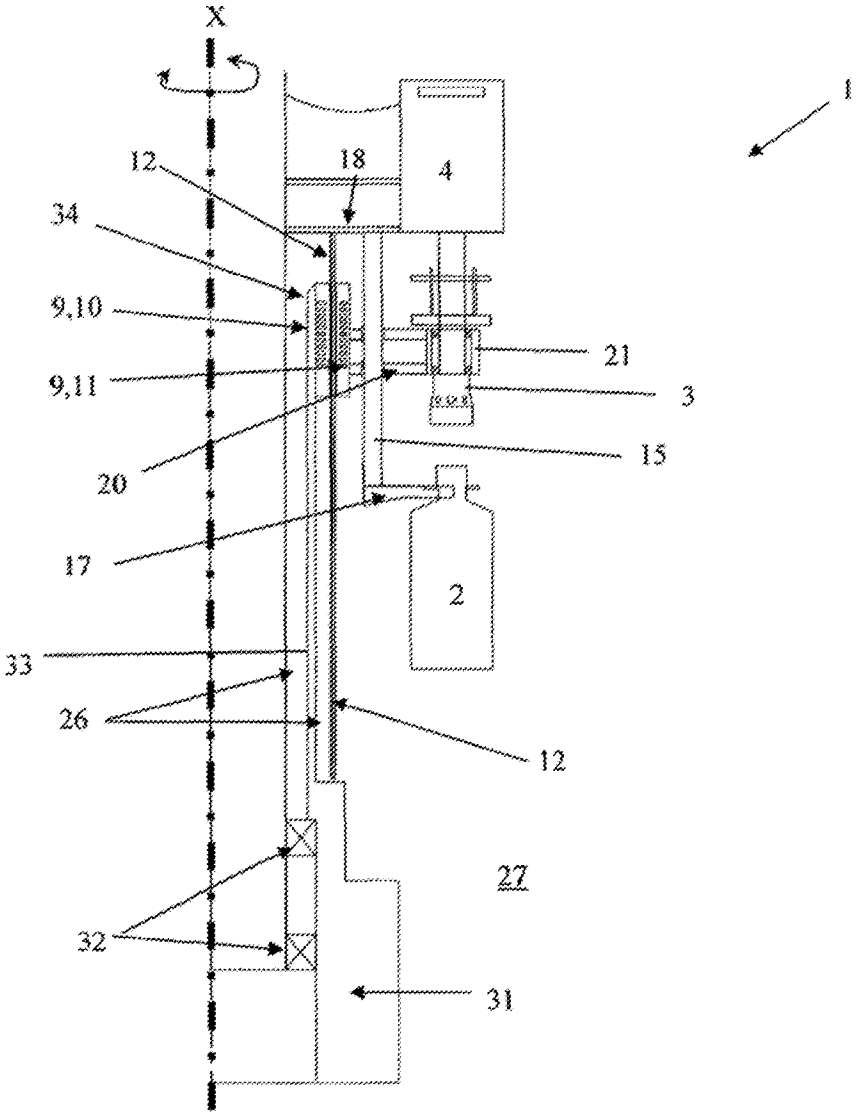
FIG. 3 shows an outline sketch in side view of a further embodiment having a single closer station.

A further example of an embodiment is illustrated in FIG. 3. Furthermore, the container driver is arranged on the free end 19 of the outer linear guide 13.

The first inner magnet element 10 is, in contrast to the example of the embodiment in FIG. 1, stationary in the direction of rotation and periphery of the rotor 16. In this regard, the inner magnet element 11 has corresponding uncoupling bearings 32 in its foot area 31. The inner linear guide shown in FIG. 1 is omitted.

The foot area 21 is made step-like by way of example, and transitions into a column 33 running parallel to the vertical machine axis X. This column has having an outer periphery on which permanent magnets 30 are arranged.

In contrast to the embodiment shown in FIG. 2, the dividing wall 12 extends completely in a straight line in the direction of the foot area 31. The free end 35 of the dividing wall 12 is at a distance from the foot area 31, which is useful with regard to the movement relative to the foot area 31 as the dividing wall 12 rotates while the foot area 31 or the first inner magnet element 10 does not rotate.

An embodiment is feasible in which the permanent magnets 30 can be arranged on an inner periphery of the column or of the head area 34.

The permanent magnets 30 are now arranged in the vertical direction and circumferential direction so that the second outer magnet element 11 rotating past is carried effectively along a lifting curve, and this necessary height movement, as described in FIG. 1, is transmitted onto the closer tool 3 or onto the cone 6.

Instead of the permanent magnets 30, controllable electromagnets can also be provided. Preferably, the former would have electro-magnets that can control inner magnet elements 10. The electro-magnets could, as described in FIG. 1, be controlled by a control unit.

It is also expedient, as in the embodiment shown in FIG. 3, for a product space 27 and a drive space 26 separated from it to be formed by the dividing wall 12. In particular, a sterile or sterilizable product space 27 can be separated from an unsterile working space 26.

Similarly, a closer station with a closer stamp can also be made as a (crown) corking machine. The rotary drive would of course not be needed in this case.

Figure 4:
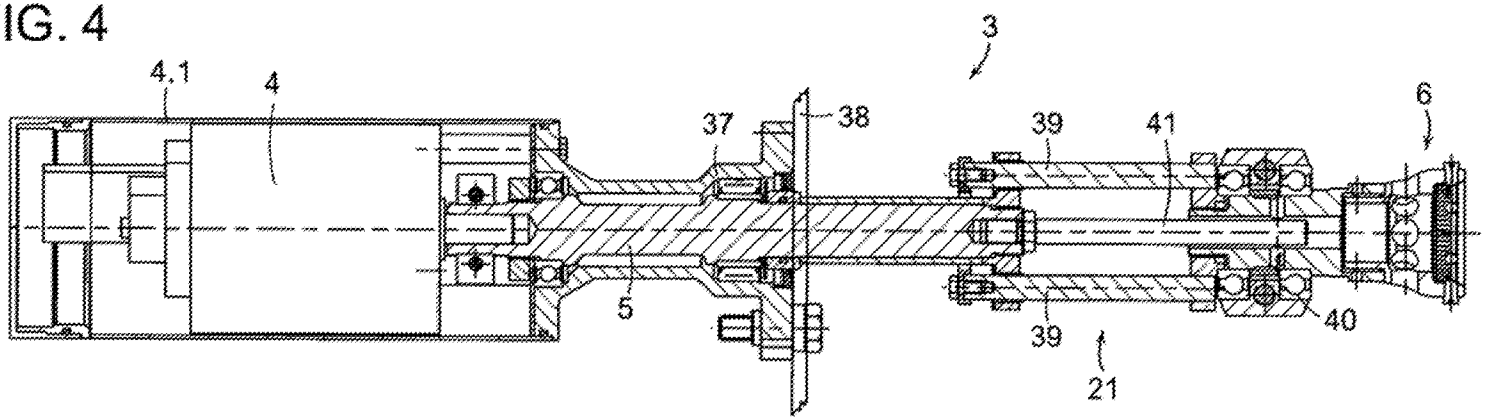
FIG. 4 shows a section drawing of a magnified illustration of a closer tool.
Figure 5:
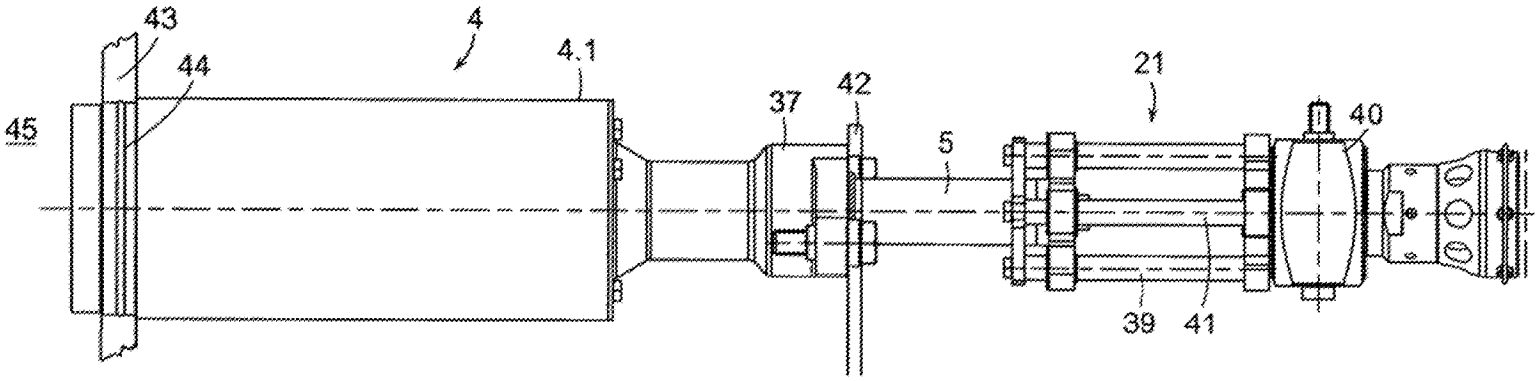
FIG. 5 shows a side view of the closer tool with a drive from FIG. 4.

FIG. 4 shows the closer tool 3 with allocated rotary drive 4. In the embodiment of FIG. 4, the rotary drive 4 is attached, by its foot housing 37, to a cover 38, whereby the cover 38 can be described as an inner space cover 38. The shaft 5, or its stationary shaft part 7, which can be rotated, extends through the foot housing 38. In the embodiment of FIG. 4, the shaft part 7 is connected to the guide sleeve 21, which, by way of example, has four linear guides or linear rods 39, of which only two can be seen due to the representation selected. On the head side, the guide sleeve 21 is connected to the foot end of the shaft part 7 or of the shaft 5. On the foot side, the guide sleeve 21 has a suitable bearing 40. On the head side, the mounting rods 39 could be pushed in an axial direction relative to the shaft 5 in the direction of the rotary drive 4. The guide sleeve 21 can thus be moved relative to shaft 5 in an axial direction but also in a rotational direction and serves, with the simultaneous relative change in the distance between rotary drive 4 and closure head 6, also for the transmission of rotational force onto the closure head or cone 6. In this respect, the guide sleeve 21 with the bearing 40 also assumes the function of the moveable shaft part 8 described in FIG. 1. The connecting arms or arms 20 can engage on the outer periphery of the bearing 40. The closer tool 3 also has an ejector 41, which will not be considered in detail here. In the view and embodiment according to FIG. 5, only one supporting element 42 is provided at the position hitherto of the inner space cover, whereby the rotary drive 4 is attached to the supporting element. Moreover, the inner space extends through to the cover and transition plate 43 into which the outer sleeve 4.1 of the rotary drive 4 is inserted and which is sealed by means of an annular seal 44. The cover and transition plate 43 represent the base plate of an electro-space 45 into which the outer shell 4.1, open at the top, of the rotary drive 4 projects. Otherwise, the example of the embodiment according to FIG. 5 corresponds to the example of an embodiment according to FIG. 4.

Although, in the above examples of embodiments and figures, only one closer in a carousel design is shown and described, the mode of action and the basic principle can be transferred similarly to linear closers or linear filling and closing machines. In this case, the closer tools are arranged in a row one after the other.

In linear filling and closing machines that work in steps or sequentially, such as those described in DE102005032322A1, the closer tools of the closer stations are arranged in a group diagonally and above the main transport path of the containers and can be moved jointly vertically.

The linear guides and magnetic drivers can moreover ideally be arranged, in a manner similar to those described above, into a product space and a drive space separate from the product space by a dividing wall. In particular, in this way, a sterile or sterilizable product space can be separated from an unsterile working space or a space of a lesser cleanliness.

The invention claimed is:

1. An apparatus comprising a closing machine for closing containers, said closing machine comprising:

closing stations, wherein each of said closing stations comprises:

a drive space formed separately from a product space;

a closer tool within said product space;

a magnetically acting coupling element comprising an inner magnet element in the drive space and an outer magnet element in the product space;

wherein movement of the inner magnet element controls movement of the outer magnet element;

a linear guide comprising an inner linear guide in the drive space and an outer linear guide in the product space;

a driver connected between the outer magnet element and the closer tool;

wherein said inner magnet element is guided by said inner linear guide for movement of said inner magnet element in a vertical direction;

wherein said outer magnet element is guided by said outer linear guide for controlled movement of said outer magnet element in a vertical direction; and wherein said driver moves said closer tool as said outer magnet element is moved in said controlled movement.

2. The apparatus of claim 1, further comprising a dividing wall, wherein said dividing wall is disposed between said inner magnet element and said outer magnet element.

3. The apparatus of claim 2, wherein said dividing wall is a rigid dividing wall.

4. The apparatus of claim 2, wherein said dividing wall separates said product space from said drive space, and wherein said product space is a sterilizable space.

5. The apparatus of claim 1, wherein said inner magnet element is configured for being moved along said inner linear guide by a control cam.

6. The apparatus of claim 1, wherein said inner magnet element is configured to be moved along said inner linear guide by a motor.

7. The apparatus of claim 1, wherein said driver comprises a connecting arm, and a guide sleeve, wherein said outer linear guide connects said connecting arm to said outer magnet element, wherein said guide sleeve includes a section of said closer tool.

8. The apparatus of claim 1, wherein said driver comprises a connecting arm, and a guide sleeve, wherein said outer linear guide connects said connecting arm to said outer magnet element, wherein said guide sleeve is attached to said closer tool.

9. The apparatus of claim 1, wherein said closer tool comprises a variable-length shaft, wherein said shaft comprises a stationary shaft part and a movable shaft part.

10. The apparatus of claim 9, wherein said variable-length shaft is a telescoping shaft.

11. The apparatus of claim 1, wherein said magnet elements comprise permanent magnets.

12. The apparatus of claim 1, wherein said inner magnet element comprises controllable electromagnets.

13. An apparatus comprising a closing machine for closing containers, said closing machine comprising:

a rotor configured to rotate about a vertical machine axis, and at least one closing station arranged on said rotor, said at least one closing station comprising:

a drive space formed separately from a product space;

a closer tool within said product space;

a magnetically acting coupling element comprising an inner magnet element in the drive space and an outer magnet element in the product space;

a driver connected between the outer magnet element and the closer tool;

a linear guide comprising an inner linear guide in the drive space and an outer linear guide in the product space;

wherein said inner magnet element is guided by said inner linear guide to follow a vertical movement path;

wherein said outer magnet element is guided by said outer linear guide to follow a vertical movement path;

wherein said driver moves said closer tool as said outer magnet element is moved; and wherein said inner magnet element is configured as a lifting and control cam that causes said outer magnet element to also rotate around said vertical machine axis when following said vertical movement path of said inner magnet element.

14. The apparatus of claim 13, further comprising a dividing wall, wherein said dividing wall is disposed between said inner magnet element and said outer magnet element.

15. The apparatus of claim 13, wherein said driver comprises a connecting arm and a guide sleeve, wherein said outer linear guide connects said connecting arm to said outer magnet element, wherein said guide sleeve includes a section of said closer tool.

16. The apparatus of claim 13, wherein said driver comprises a connecting arm, and a guide sleeve, wherein said outer linear guide connects said connecting arm to said outer magnet element, wherein said guide sleeve is attached to said closer tool.

17. The apparatus of claim 13, wherein said closer tool comprises a variable-length shaft, wherein said variable-length shaft comprises a stationary shaft-part and a movable shaft-part.

18. The apparatus of claim 17, wherein said variable-length shaft is a telescoping shaft.

19. The apparatus of claim 13, wherein said magnet elements comprise permanent magnets.

20. The apparatus of claim 13, wherein said inner magnet element comprises controllable electromagnets.

* * * * *